US005772110A

United States Patent [19]

Garretson

[11] Patent Number: 5,772,110

[45] Date of Patent: Jun. 30, 1998

[54] STACKABLE SERIES OF INTERCONNECTED BOXES

[76] Inventor: John E. Garretson, 3521 E. Rose La., Paradise Valley, Ariz. 85253

[21] Appl. No.: 858,855

[22] Filed: May 19, 1997

[51] Int. Cl.[6] ..... B65D 25/04

[52] U.S. Cl. ..... 229/120.21; 229/120.18; 229/120.08; 229/120.03; 206/750; 206/749

[58] Field of Search ..... 229/120.21, 120.03, 229/120.08, 120.09, 120.017, 120.018, 120.29, 23 R, 120.01, 120.011, 120.24, 120.28, 120.32; 206/748, 747, 749, 750

[56] References Cited

U.S. PATENT DOCUMENTS

| | | | |
|---|---|---|---|
| 294,983 | 3/1884 | Traver | 206/748 |
| 386,807 | 7/1888 | Fleisch | 206/748 |
| 1,035,258 | 8/1912 | Stegman | 229/120.11 |
| 4,971,242 | 11/1990 | LaNicca | 229/120.21 |
| 5,069,332 | 12/1991 | Williams et al. | 206/748 X |
| 5,291,990 | 3/1994 | Sejzer | 206/748 |

*Primary Examiner*—Allan N. Shoap
*Assistant Examiner*—Tri M. Mai
*Attorney, Agent, or Firm*—Joseph H. Roediger

[57] ABSTRACT

A stackable series of interconnected boxes of equal size die cut from a single cardboard blank. When assembled, the boxes are oriented in a stack so that the lid of each box faces upwardly. Access to each succeeding box is provided by the alternate hinging of successive boxes on opposite sides of the vertical stack. Each preceding box is rotated to the side to expose the lid of the next succeeding box in the stack.

10 Claims, 3 Drawing Sheets

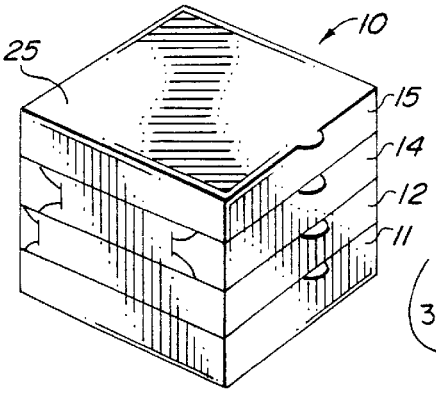
FIG. 1
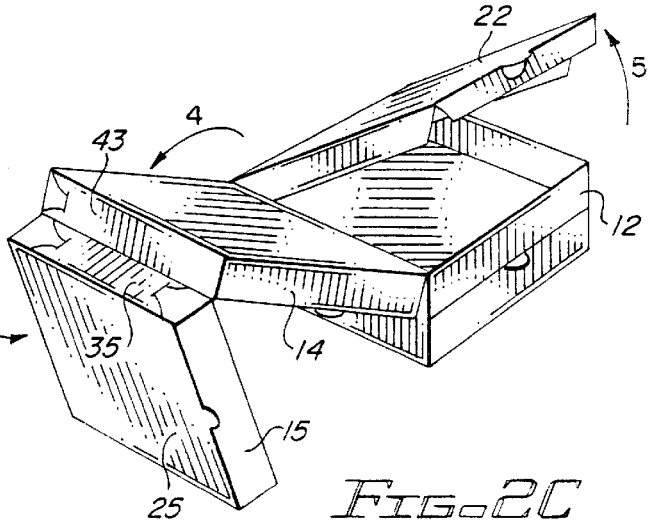
FIG. 2C
FIG. 2A
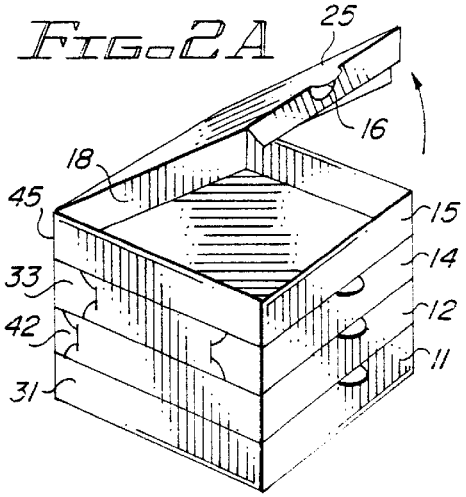
FIG. 2D
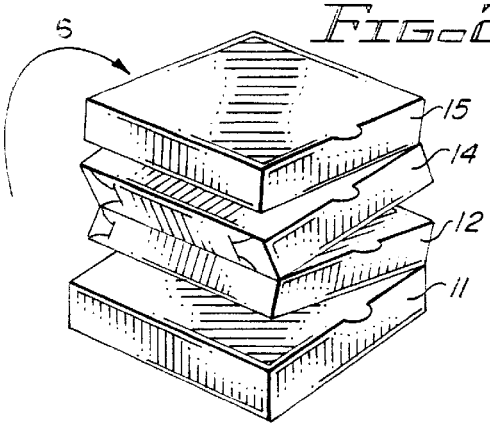
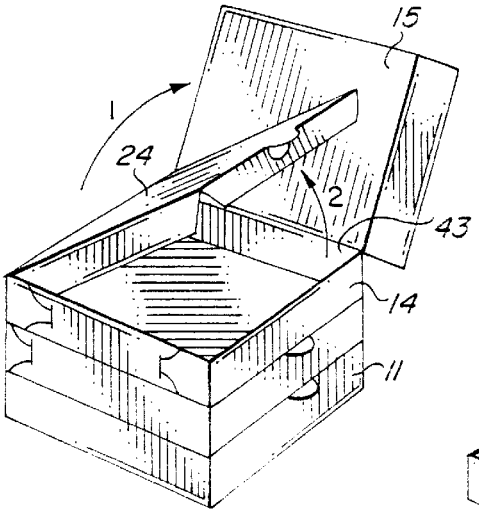
FIG. 2B
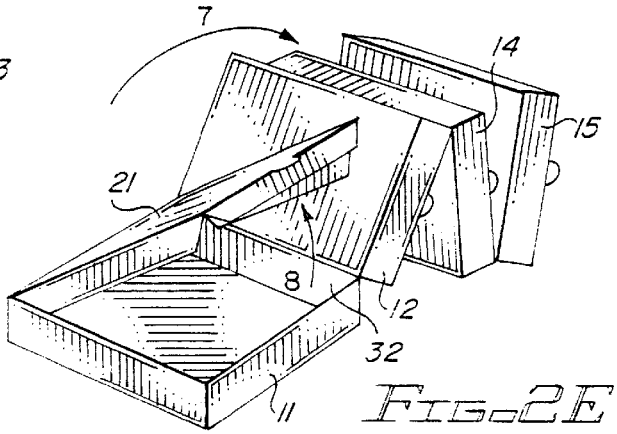
FIG. 2E

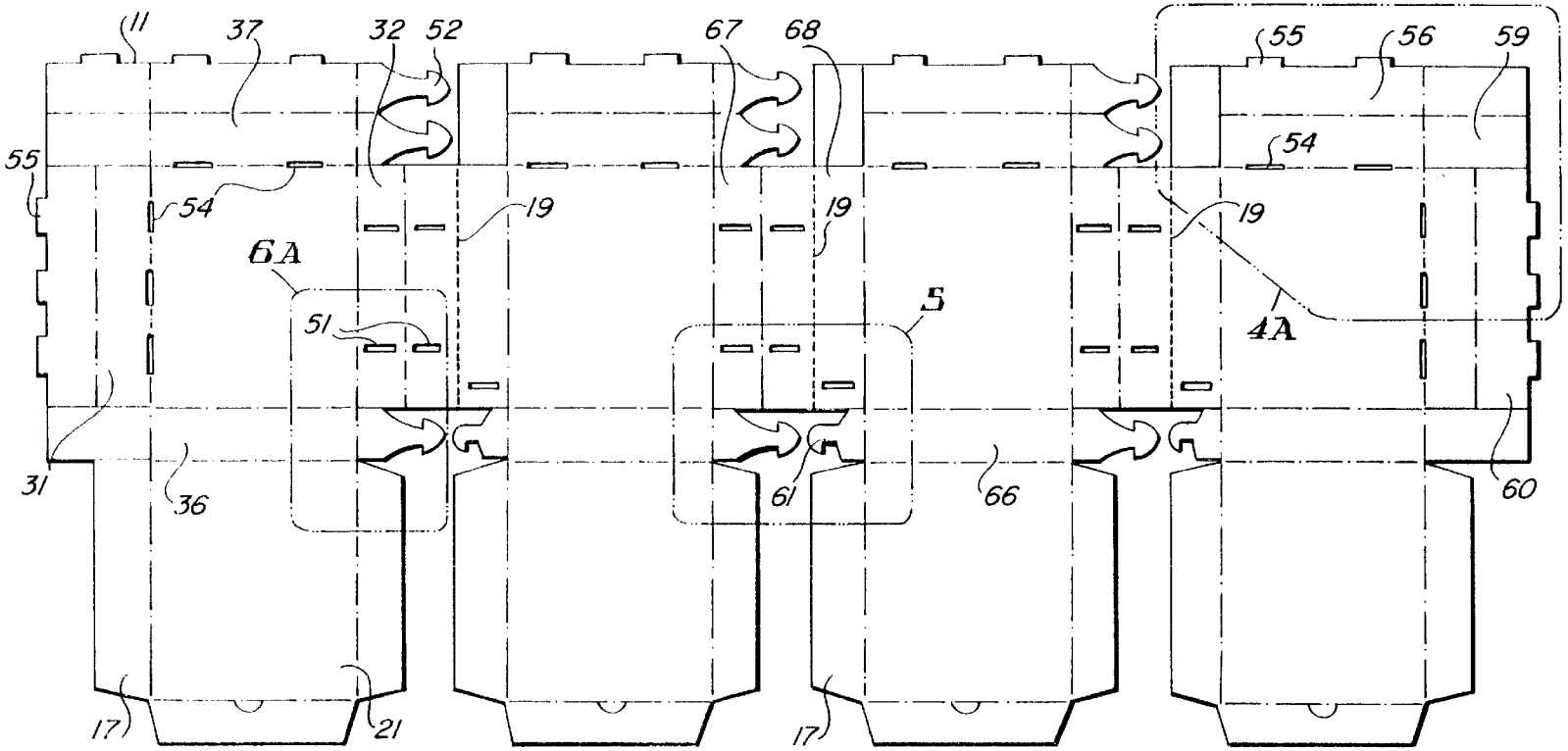
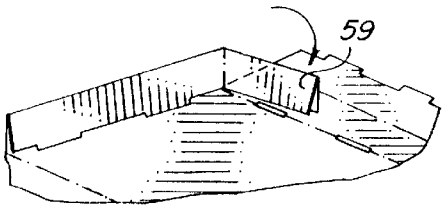
FIG. 4C
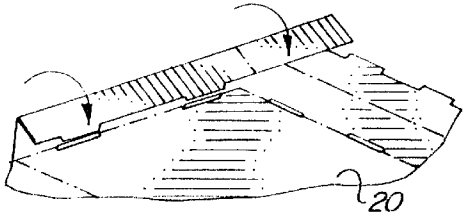
FIG. 4B
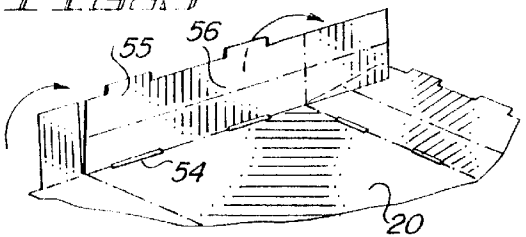
FIG. 4A
FIG. 3

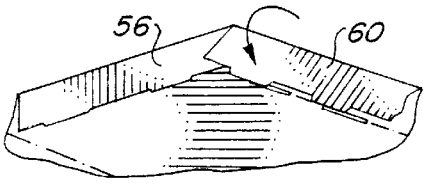
FIG. 4D
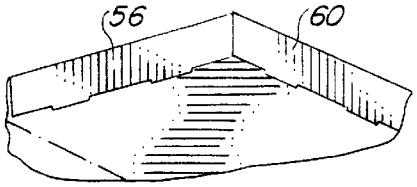
FIG. 4E
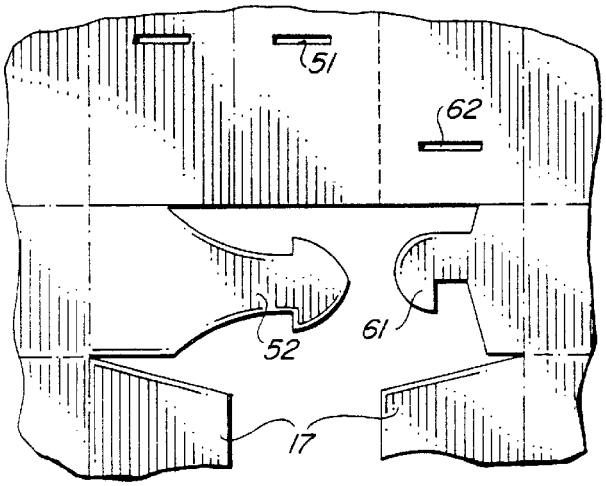
FIG. 5
FIG. 6A
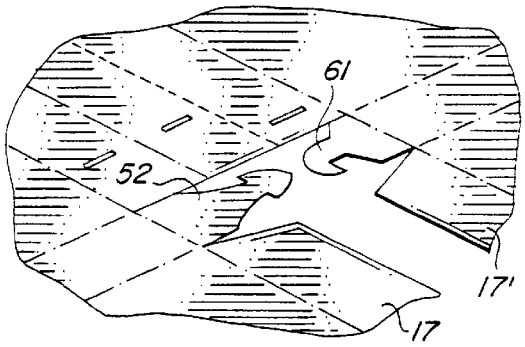
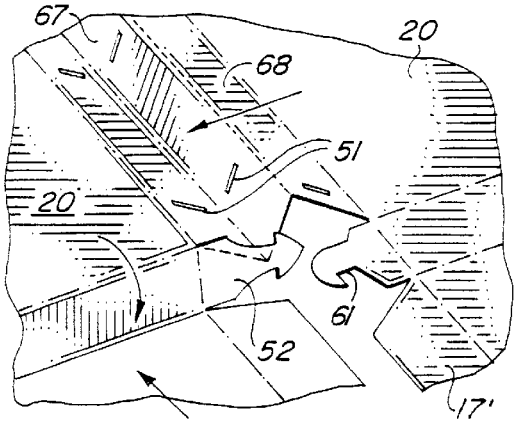
FIG. 6B
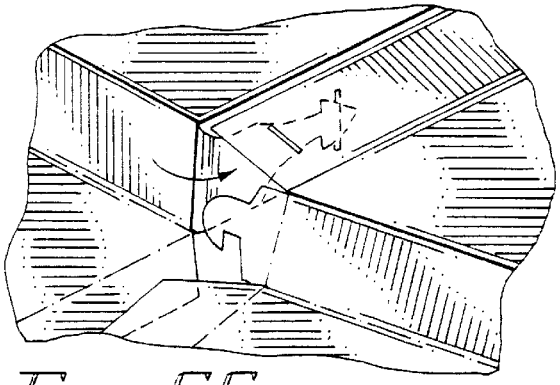
FIG. 6C
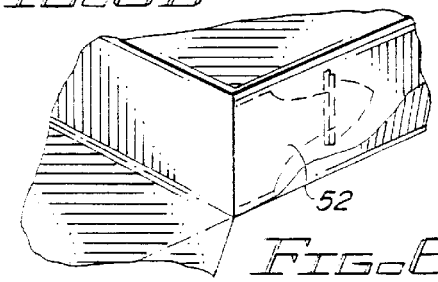
FIG. 6D
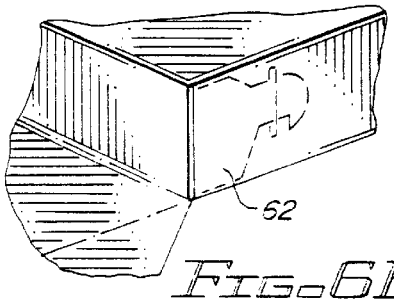
FIG. 6E

STACKABLE SERIES OF INTERCONNECTED BOXES

BACKGROUND OF THE INVENTION

The present invention relates to a stackable series of interconnected boxes in which the boxes are positioned in a vertical stack with the lid of each box being accessible upon successive movement of the overlying boxes in the stack.

The use of cardboard boxes to transport prepared foodstuffs from the point of sale to the place of consumption or storage is widespread. Present societal trends have led to an ever increasing transport of prepared food to the home. The size of the item being transported has heretofore dictated the size of the box. The popularity of large prepared items, for example pizza, has created a problem for the purchaser carrying additional items in that the large box is unwieldy and difficult to manage unless carried with both hands. Furthermore, these large prepared food items must be maintained in an upright position during transport else they become damaged and are less than presentable when served. The tilting or inversion of the container typically causes the adjacent portion of the prepared food item to adhere to the container thereby rendering it unfit to serve. In the case of baked goods such as decorated cakes and heated cheese-covered items such as pizza and casseroles, all contact between the top surface of the food item and the box is to be avoided.

Many large food items are purchased immediately after preparation and are intended to be served warm without reheating. Thus, a temperature drop experienced during transport is undesirable. The large planar boxes now in use have large area surfaces thereby permitting significant heat loss. As mentioned, the surface area of a box is determined by the size of the food item so that reducing the rate of heat loss during transport typically requires the use of more expensive material for the box. Alternatively, an insulated sleeve may be used to receive the large box. The use of the sleeve adds additional cost and frequently has to be returned to the merchant.

Since large prepared food items are subdivided into individual portions for consumption, the use of multiple smaller boxes to contain a segment of the larger food item is suggested. In this situation, the multiple boxes each have to be maintained in an upright position to avoid damaging the contents. The individual boxes must then be loaded into a suitable carrying bag and the relative positions of the items within the boxes have to be maintained until the destination is reached and the item is either served or stored. Alternatively, small individual boxes can be strapped or bound together for transport immediately after loading. These approaches require additional handling of the individual boxes to form the assemblage and then require that the assemblage be further handled to bind the boxes into one unit. Each handling step increases the likelihood of relative movement of the stored contents and resultant damage thereto.

Also, the storage of large area food items in the freezer unit of a typical home refrigerator is often not practical without rehandling of the food. The increasing sizes of prepared pizzas, sheet cakes and the like often require that the food item be removed from its original transport container, subdivided and placed in smaller containers for freezer storage. In addition to being awkward for handling and storage, the large container tends to cause the rehandling of the food item thereby increasing the possibility of contact with the container.

Accordingly, the present invention is directed to the provision of a series of interconnected boxes wherein the relative position of each individual box is maintained during placement of the contents therein, during subsequent transport and while unloading the contents at the point of use. The novel interconnection of the individual boxes in the invention provides a vertical stack of boxes in which the lid of each individual box is facing upwardly in the stack. The orientation of the individual boxes in the stack allows the boxes to be serially loaded and unloaded without the need to move a loaded box.

Since the orientation of the boxes remains fixed during loading and transport, the need to bind or strap the boxes together for transport is obviated. Furthermore, the boxes of the present invention are adjacently positioned in the resultant stack thereby reducing the surface area from which heat loss occurs.

The novel construction of the stackable series of boxes permits assembly from a precut cardboard blank. The cardboard may be corrugated for strength or treated to resist absorption of liquids. Further, the number of interconnected boxes in the stack can be changed by incorporating tear lines into the present blank thereby enabling one or more boxes to be removed from the assembled stack. Thus, storage of all or a portion of the stacked series of boxes can be accomplished without the removal of the food item and placement in another container. The individual boxes are readily accommodated by the freezer unit of a typical home refrigerator.

SUMMARY OF THE INVENTION

The present invention provides a series of interconnected parallelepiped boxes formed from a precut blank which is readily manipulated to provide a vertical stack. Each box in the stack is provided with a lid and the lids of the interconnected boxes in the stack all are upwardly facing during transport.

The series of interconnected boxes formed in accordance with the present invention includes a bottom box, a first intermediate box and a top box. Each box has a lid, a bottom panel, first and second opposing free walls and first and second opposing interconnect walls extending therebetween the free walls. The interconnect walls provide the means for attachment to the adjacently positioned box in the stack. The interconnect walls are hingedly attached for rotation off the vertical stack to permit access to successive boxes in the stack. The first interconnect wall of the top box is hingedly attached to the vertically adjacent second interconnect wall of the next intermediate box. The first or opposing interconnect wall of the intermediate box is hingedly attached to the vertical adjacent second interconnect wall of the bottom box. Additional intermediate boxes can be included in the stack by using the same attachments to the adjacent boxes.

The series of interconnected boxes are formed from a single cardboard blank. The assembly of the series of boxes can be accomplished at the point of service or prior thereto. By providing a tearline in the blank at the line of hinged attachment between interconnect walls, the individual boxes can be removed from the stack.

An important feature of the stack is that the overlying boxes are rotated out of the way to permit opening of the lid of the bottom box. When this bottom box is filled and its lid closed, the adjacent overlying box is rotated into position to rest on the closed lid of the bottom box. The rotation of the next intermediate box onto the bottom box causes all additional boxes in the series to also be rotated in that direction.

The rotation of the overlying boxes continues so that access is provided to the lid of the box resting on the bottom box. This lid is opened and the contents inserted followed by closing of the lid. Next, the remaining boxes in the stack are rotated in the opposing direction to allow the next succeeding box to rest on the first intermediate box. Again, rotation of additional boxes continues in that direction to provide access to this about to be filled box. In this manner, the remaining boxes in the vertical stack are filled. It is important to note that the filled boxes are not moved during the placement of the contents in the succeeding in the stack. Thus, relative movement of the contents in the underlying boxes is essentially eliminated.

When all boxes have been filled, the vertical stack is transported at a unit to the point of consumption or storage. As with all containers, care must be used in transporting the vertical stack. However, the compact size of the vertical stack facilitates careful movement and permits placement in a shopping bag or other transport carrier.

The transport of heated food items is enhanced by the use of the present invention. The top and bottom boxes are exposed on one side to the environment and heat loss occurs from these surfaces. The intermediate lids and adjacent bottom panels of the individual boxes in the stack are not exposed to the environment and heat loss from the stack is significantly reduced. Consequently, the present invention provides an improved container for delivering heated food items. Upon arrival at the place of consumption, the process is reversed with the top box being first unloaded. Should the entire contents not be consumed, the remaining filled boxes may be separated from the empty boxes in the stack and placed in storage.

Further features and advantages of the invention will become more readily apparent from the following detailed description when taken in conjunction with the accompanying drawings.

BRIEF DESCRIPTION OF THE DRAWINGS

FIG. 1 is a perspective view of a four box embodiment of the present invention.

FIGS. 2A through 2E are a series of perspective views showing the manner of accessing the individual boxes in the embodiment of FIG. 1.

FIG. 3 is a plan view of the blank from which the embodiment of FIG. 1 is formed.

FIGS. 4A through 4E are a series of perspective views showing steps in the assembly of the embodiment of FIG. 1.

FIG. 5 is a plan view of the blank of FIG. 3 showing a locking dart and locking hook.

FIGS. 6A through 6E are a series of perspective views showing further steps of the assembly of the embodiment of FIG. 1.

DESCRIPTION OF THE PREFERRED EMBODIMENT

Referring now to the drawings, FIG. 1 shows a series of four interconnected parallelepiped boxes in a vertical stack in accord with the invention. As will later be explained in detail, the boxes are interconnected at alternate sidewalls, herein termed interconnect walls, to permit the lids of the individual boxes to be successively accessible upon rotation of the preceding box off the stack. The vertical stack is identified with numeral 10 and the individual boxes in the vertical stack are designated 11, 12, 14 and 15 beginning with the bottom box. The top box 15 is provided with lid 25.

The manner of use of the individual compartments forming stack 10 is shown in FIGS. 2A through 2E. In FIG. 2A, the top box 15 is shown with lid 25 in a partially open position. Opening tab 16 is provided at the front edge of the lid to facilitate opening of the box. After removal of the contents of top box 15, the box 15 is rotated in the direction shown by arrow 1 of FIG. 2B thereby providing access to lid 24 of intermediate box 14. Since the top box is joined to intermediate box 14 at the edge of interconnect wall 43, the top edge of the wall defines the axis of rotation for the top box.

When the next box in the stack is to be opened, the intermediate box 14 is closed and both boxes 15 and 14 are rotated in the directions of arrows 3 and 4 in FIG. 2C. The top box is first moved toward its original position on the stack as shown in FIG. 2A and the underlying box is rotated about an axis defined by the top edge of interconnect wall 42 of intermediate box 12. When the position shown in FIG. 2C is reached, lid 22 of box 12 can be opened to access the stored contents. Upon closure of lid 22, the three boxes 15, 14 and 12 are rotated in the opposite direction as shown by arrow 6 of FIG. 2D. The axis of rotation is defmed by the edge of the interconnect wall 32 of bottom box 11. The completed movement of the three boxes as shown by arrow 7 of FIG. 2E enables the lid 21 of box 11 to be opened as shown by arrow 8. While access to the interior of the boxes in the stack is provided sequentially in the manner shown in FIGS. 2A through 2E, it is to be noted that filling the boxes takes place in the reverse order.

The series of boxes in the stack 10 are interconnected through the use of alternate pairs of vertically-adjacent sidewalls. The interconnections are alternated from side to side throughout the stack. The axis of rotation between two adjacent boxes is defined by the horizontal juncture between the vertically-adjacent sidewalls. The rotation axis moves to alternate sides of the stack as the boxes are opened.

The interconnected boxes of FIG. 1 are constructed from the blank shown in FIG. 3. The blank is die cut preferably from corrugated cardboard with scored for folding lines and full and partial die cut lines as shown. The partial die cut lines 19 are also scored for folding and are included in embodiments wherein separation of one or more boxes from the stack is contemplated. In the case where separation is not to be provided, for example when the series of boxes are intended for reuse, lines 19 are only scored for folding. The construction of the stack from the blank is best understood from viewing the partial assembly steps in FIGS. 4A through 4E and FIGS. 6A through 6E.

The blank as shown begins with bottom box 11 at the left. In flattened form the box includes a bottom panel 20 bounded by opposing first and second free walls 36, 37 respectively. The lid 21 is attached to free wall 36 at a fold line. Flanges 17 depend from the side of each lid for insertion into the box when assembled. Box 11 also includes opposing first and second interconnect walls 31, 32 respectively. As shown, the first interconnect wall 31 of the bottom wall is unattached. The second interconnect wall 32 includes spaced pairs of slots 51 which receive locking darts 52 located at the end of the free walls 36, 37 when the folding for assembly takes place.

The bottom panel of the four boxes includes a plurality of spaced receiving slots adjacent to the juncture of the second free wall and the bottom panel. The second free wall contains a central longitudinal fold line. At the exposed edge of the second free wall are locking tabs which upon folding of the free wall are inserted into the receiving slots as shown in FIGS. 4A and 4B. The free wall 56 of the top box 15 has folded end 59 to be positioned as shown in FIG. 4C for placement beneath the end interconnect wall 60 thereby forming a reinforced corner as shown in FIG. 4E.

The second interconnect walls of the bottom and intermediate boxes include slots 51 to receive the locking darts 52 located on the opposing free walls. The fold lines for the adjacent walls are seen in FIG. 5. It is to be noted that the preferred embodiment includes a locking hook 61 which engages the slot 62 in each of the first interconnect walls joined to the second interconnect wall of an adjacent box. The hook 61 facilitates assembly and serves to draw the adjacent walls together at the corner due to the slope of the inner portion of the hook. Other configurations for the locking hook can be used to draw the ends together.

The assembly of a locking dart and locking hook into the corresponding receiving slots is shown in FIGS. 6A through 6E. The flanges 17 of the lids are to be bent in opposing directions with flange 17' of FIG. 6B being bend upwardly. The assembly of the stack produces a linear array of boxes in which the openings alternately face up and down. When configured into a stack, the lids of all boxes then face upwardly. Thus, the folds shown in FIG. 6B are reversed for the adjacent boxes. In both cases, the second interconnect wall 67 is folded and the locking dart 52 inserted into the aligned receiving slots 51 as shown by the arrow and dashed outline in FIGS. 6C and 6D. The locking hook 61 is then inserted into the receiving slot 62 located in the first interconnect wall 68 of the adjacent box.

The length of the blank of FIG. 3 can be increased by the addition of intermediate boxes. However, the configuration of the intermediate boxes remains constant. The boxes defining the end of the stack have different wall configurations as shown in FIG. 3. The last box in the blank lacks the locking darts since it terminates the series. The first box in the blank lacks the locking hook in this embodiment in favor of a more rigid double thickness wall. The partial die cut lines 19, included as an elective feature in the preferred embodiment, are one less in number than the boxes in the stackable series.

The present invention provides an easy to carry multiple compartment product container which fits into a shopping or tote bag in the upright position. The product container can be employed for a variety of purposes in addition to the transport of heated food items. However, a primary advantage of the invention is that for a given volume, the surface area of the area is substantially reduced from that of the conventional pizza box. In one embodiment of the invention wherein four boxes of 6 by 7 inch dimensions were used, the standard medium or 12 inch pizza of about 114 square inches was easily stored and transported. Also, by separating the stack at its midpoint enables one-half of the pizza to be added to the freezer compartment of a refrigerator without substantial reorganization. In addition, the original container can be used to later reheat the stored food item in a microwave oven. The ease of transport and the ready access to one compartment at a time without exposing or disturbing the contents of the other compartments serve to provide an improved series of boxes for handling prepared food items.

While the above description has referred to a specific embodiment of the invention, it is to be noted that variations and modifications may be made therein without departing from the scope of the invention as claimed.

I claim:

1. A series of interconnected parallelepiped boxes forming a stack, said series comprising:

a) a bottom box, a first intermediate box and a top box in the stack, each box having a lid, a bottom panel, first and second opposing free walls and first and second opposing interconnect walls extending therebetween;

b) said bottom box forming the base of the stack, the lid of said bottom box facing upward when in said stack;

c) said first intermediate box having an upward-facing lid when in said stack, the first interconnect wall of the first intermediate box being hingedly attached to the vertically-adjacent second interconnect wall of the bottom box;

d) said top box having an upward-facing lid when in said stack, the first interconnect wall of the top box being hingedly attached to the vertically-adjacent second interconnect wall of the first intermediate box whereby the series of boxes form a vertical stack having upward-facing lids, said lids being successively accessible upon movement of the preceding boxes in the stack.

2. The series of interconnected boxes in accordance with claim 1 wherein the lid on each box is hingedly attached to a free wall thereof.

3. The series of interconnected boxes in accordance with claim 2 wherein the first and second interconnect walls of adjacent boxes are removably attached to permit separation of the boxes in the stack.

4. The series of interconnected boxes in accordance with claim 1 further comprising at least one receiving slot located in the bottom panel of each box adjacent to the second free wall thereof, and a locking tab located on the second free wall for insertion into said at least one receiving slot.

5. The series of interconnected boxes in accordance with claim 4 wherein the bottom box further comprises at least one receiving slot located in the bottom panel thereof adjacent the first interconnect wall, and a locking tab located on the first interconnect wall for insertion into said at least one receiving slot.

6. The series of interconnected boxes in accordance with claim 5 wherein the top box further comprises at least one receiving slot located in the bottom panel thereof adjacent the second interconnect wall, and a locking tab located on the second interconnect wall for insertion into said at least one receiving slot.

7. The series of interconnected boxes in accordance with claim 6 wherein the second interconnect wall of said bottom and first interconnect boxes contains a central fold to provide an interconnect wall of double thickness.

8. The series of interconnected boxes in accordance with claim 7 wherein the second interconnect wall of the bottom box and the intermediate box each contain spaced receiving slots, and the first and second free walls each contain a locking dart for insertion into a receiving slot.

9. The series of interconnected boxes in accordance with claim 8 wherein the first interconnect wall of the top box and the intermediate box each contain a receiving slot proximate to the first free wall thereof, and said first free wall includes a locking hook for insertion into said receiving slot.

10. The series of interconnected boxes in accordance with claim 9 further comprising a second intermediate box connected to the second interconnect wall of the first intermediate box and to the first interconnect wall of the top box, said second intermediate box having a second interconnect wall of double thickness.

* * * * *